US010337510B2

(12) United States Patent
Maki et al.

(10) Patent No.: US 10,337,510 B2
(45) Date of Patent: Jul. 2, 2019

(54) WEAR-RESISTANT COATING FOR OIL PUMP CAVITY

(71) Applicant: Ford Global Technologies, LLC, Dearborn, MI (US)

(72) Inventors: Clifford E. Maki, New Hudson, MI (US); Antony George Schepak, Howell, MI (US); James Maurice Boileau, Novi, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 349 days.

(21) Appl. No.: 15/423,990

(22) Filed: Feb. 3, 2017

(65) Prior Publication Data

US 2018/0223835 A1 Aug. 9, 2018

(51) Int. Cl.

| | |
|---|---|
| ***F04C 2/08*** | (2006.01) |
| ***F01M 1/02*** | (2006.01) |
| ***F04C 2/10*** | (2006.01) |
| ***F04C 2/344*** | (2006.01) |

(Continued)

(52) U.S. Cl.

CPC ..... *F04C 2/086* (2013.01); *C23C 4/06* (2013.01); *C23C 4/131* (2016.01); *F01M 1/02* (2013.01); *F04C 2/102* (2013.01); *F04C 2/344* (2013.01); *F01M 2001/0238* (2013.01); *F04C 2210/206* (2013.01); *F04C 2230/91* (2013.01); *F04C 2240/10* (2013.01); *F04C 2240/30* (2013.01); *F05C 2201/021* (2013.01); *F05C 2201/0448* (2013.01)

(58) Field of Classification Search

CPC ..... F04C 2230/91; F04C 2240/30; F04C 2210/206; F04C 2230/92; F04C 2240/20; F01M 1/02; F01M 2001/0238

See application file for complete search history.

(56) References Cited

U.S. PATENT DOCUMENTS

| | | | | |
|---|---|---|---|---|
| 3,396,667 A * | 8/1968 | Schmitt | ..... | F04C 2/084 417/DIG. 1 |
| 3,860,367 A * | 1/1975 | Telang | ..... | F02B 55/08 418/178 |
| 5,638,600 A | 6/1997 | Rao et al. | | |

(Continued)

FOREIGN PATENT DOCUMENTS

| | | | |
|---|---|---|---|
| DE | 102009047153 | A1 | 5/2011 |
| WO | 2015159715 | A1 | 10/2015 |

*Primary Examiner* — Long T Tran

(74) *Attorney, Agent, or Firm* — Julia Voutyras; Brooks Kushman P.C.

(57) ABSTRACT

Oil pumps having wear-resistant coatings applied thereto and methods of applying the coatings are disclosed. The oil pump may include an aluminum housing that defines a cavity. A steel rotor may be disposed within the cavity and configured to rotate therein such that a portion of the steel rotor contacts the aluminum housing. A metal coating (e.g., steel) may cover at least a portion of the aluminum housing in a region that is configured to be contacted by the steel rotor. An integrated oil pump and engine cover is disclosed including an aluminum body having a peripheral wall defining a cavity. The peripheral wall may form a portion of the oil pump housing and the cavity may receive a steel rotor. A wear-resistant coating (e.g., steel) may cover at least a portion of the peripheral wall in a region that is configured to be contacted by the steel rotor.

20 Claims, 4 Drawing Sheets

(51) Int. Cl.
*C23C 4/06* (2016.01)
*C23C 4/131* (2016.01)

(56) References Cited

U.S. PATENT DOCUMENTS

| | | | | |
|---|---|---|---|---|
| 6,503,064 | B1 * | 1/2003 | Croke | F01C 21/08 417/326 |
| 2003/0063980 | A1 * | 4/2003 | Doll | F01C 21/08 417/221 |
| 2009/0068049 | A1 * | 3/2009 | Saito | F04C 2/3446 418/77 |
| 2013/0309109 | A1 * | 11/2013 | Wu | F02M 37/08 417/423.7 |

* cited by examiner

WEAR-RESISTANT COATING FOR OIL PUMP CAVITY

TECHNICAL FIELD

The present disclosure relates to wear-resistant coatings for oil pump cavities, for example, thermally sprayed coatings for aluminum oil pump cavities.

BACKGROUND

In general, vehicles having an internal combustion engine (ICE) will include an oil pump. The oil pump in an ICE may circulate engine oil under pressure to components of the engine, such as bearings, pistons, the camshaft, etc. The oil lubricates the components and may also cool the components. There are multiple oil pump types, such as twin gear, rotor ("gerotor"), and variable vane oil pumps. In general, oil pumps include a cavity, which may be formed (e.g., cast) of steel or aluminum. Oil pumps may include a steel gear mounted on a steel shaft. Having a steel pump gear will eventually wear out an aluminum pump cavity for engines having an extended high-mileage life. The wear on the aluminum may degrade pump output efficiency.

In addition to durability issues, the weight of the oil pump may also be a concern when trying to reduce overall vehicle weight (e.g., "light-weighting"). Traditional oil pumps generally include separate housings from the rest of the engine assemblies. This style of oil pump may require additional package clearances to assemble and service. Recent, more weight conscious designs are becoming more prevalent due to fuel economy and package space. For example, the oil pump housing may be integrated into an internal combustion engine's front cover to reduce mass and/or ease the package space issues. However, durability/wear concerns are still present in this design configuration.

SUMMARY

In at least one embodiment, an oil pump is provided. The oil pump may include an aluminum housing that defines a cavity; a steel rotor disposed within the cavity and configured to rotate therein such that a portion of the steel rotor contacts the aluminum housing; and a metal coating covering at least a portion of the aluminum housing in a region that is configured to be contacted by the steel rotor.

In one embodiment, the aluminum housing includes a wall defining a peripheral surface of the cavity and the metal coating covers at least a portion of the wall. The wall may include a substantially cylindrical portion and the metal coating may cover at least a portion of the substantially cylindrical portion. In one embodiment, the metal coating is a steel coating, such that there is a steel-steel interface in the region of the aluminum housing that is configured to be contacted by the steel rotor. The metal coating may have a microhardness of 200 to 600 HV. In one embodiment, the metal coating covers every surface of the aluminum housing that is configured to be contacted by the steel rotor. In another embodiment, the metal coating covers only surfaces of the aluminum housing that are configured to be contacted by the steel rotor.

In one embodiment, the steel rotor may be an outer rotor of a gerotor pump and may have a substantially cylindrical outer wall. The metal coating may cover a peripheral surface of the aluminum housing that is configured to be contacted by the outer wall of the steel rotor. In another embodiment, the oil pump may be a variable vane oil pump and the steel rotor may include a plurality of steel vanes. The metal coating may cover a peripheral surface of the aluminum housing that is configured to be contacted by the steel vanes of the steel rotor.

In at least one embodiment, a method is provided. The method may include applying a metal coating to a surface of an aluminum oil pump housing that is configured to receive a steel rotor. The metal coating may be configured to form a wear interface with the steel rotor when the steel rotor moves within the housing.

In one embodiment, the metal coating is applied to a peripheral wall surface of the housing that defines a cavity to receive the steel rotor. Applying the metal coating may include thermally spraying a steel coating onto the surface, the steel coating configured to form a steel-steel wear interface with the steel rotor. In one embodiment, applying the metal coating includes covering every surface of the housing that is configured to contact the steel rotor when it moves within the housing with the metal coating. In another embodiment, applying the metal coating includes covering only surfaces of the housing that are configured to contact the steel rotor when it moves within the housing with the metal coating. In one embodiment, the aluminum oil pump housing is integrally formed in an engine front cover.

In at least one embodiment, an engine cover is provided. The engine cover may include an aluminum body including a peripheral wall defining a cavity, the peripheral wall configured to form a portion of an oil pump housing and the cavity configured to receive a steel rotor; and a wear-resistant coating covering at least a portion of the peripheral wall in a region that is configured to be contacted by the steel rotor.

In one embodiment, the wear-resistant coating is a steel coating having a microhardness of 200 to 600 HV. The wear-resistant coating may cover a substantially cylindrical portion of the peripheral wall. In one embodiment, the wear-resistant coating covers every surface of the aluminum body that is configured to be contacted by the steel rotor. The aluminum body may further include a joining surface having apertures defined therein and configured to couple the engine cover to one or more oil pump components to form an integrated oil pump and engine cover assembly.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

As described in the Background, durability/wear and weight reduction continue to be areas of development for oil pumps. One approach to improving the durability of oil pumps including an aluminum cavity is to retroactively add a steel cartridge or insert to reinforce the cavity once the aluminum has begun to wear (e.g., once the vehicle has reached a relatively high mileage). This may reduce wear compared to an aluminum-steel interface, however, it may increase the weight and/or size of the oil pump and requires significant labor and reworking of the oil pump. In at least one embodiment, the present disclosure addresses both the durability/wear and weight concerns by applying a wear-resistant and light-weight coating that may eliminate the need to add a steel insert in the future.

Figure 1:
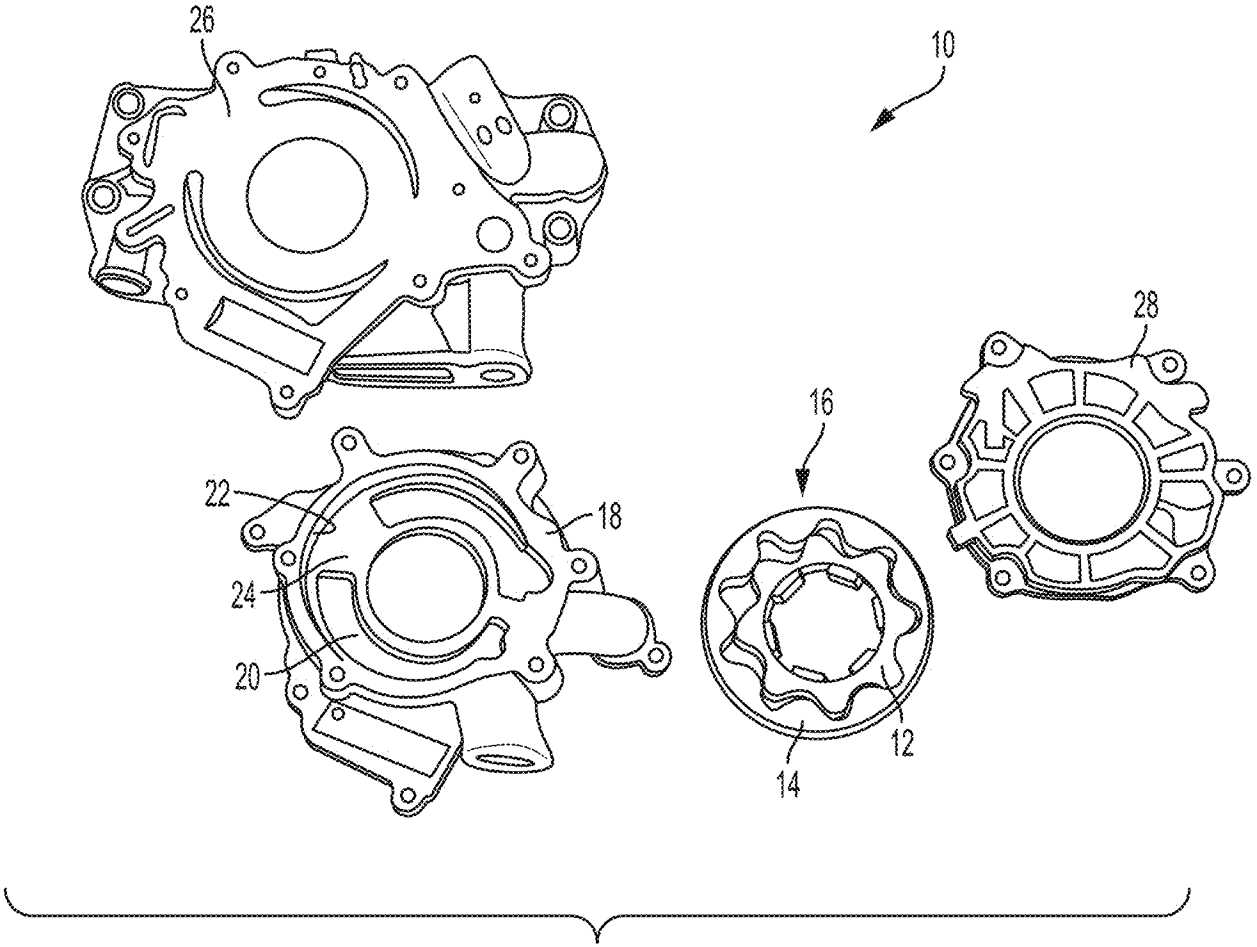
FIG. 1 is a perspective view of disassembled components of a gerotor pump, according to an embodiment.

With reference to FIG. 1, an example of a generated rotor pump 10 is shown, also referred to as a gerotor or G-rotor pump (gerotor pump will be used hereafter). A gerotor pump is a type of positive displacement pump. Gerotor pumps are known in the art and will not be described in detail. In general, a gerotor pump may have a pair of rotors including an inner rotor 12 and an outer rotor 14, together forming a rotor assembly 16. The inner rotor 12 may have N teeth, and the outer rotor 14 may have N+1 teeth (N>2). The inner rotor 12 may be located off-center with respect to the outer rotor 14, and both rotors rotate. The geometry of the two rotors may partition the volume between them into N different dynamically-changing volumes. During the rotation of the two rotors, the volumes change continuously, increasing and decreasing. When the volume increases, the pressure drops, which creates suction. This suction provides for oil intake. When the volume decreases, compression occurs, this allows the oil to be pumped.

The gerotor pump 10 may include a housing 18 that defines a cavity or chamber 20. When assembled, the rotor assembly 16 may be disposed within the cavity 20. When the gerotor pump 10 is used as an oil pump, the cavity 20 may be referred to as the oil pump cavity. The cavity 20 may have a generally cylindrical shape sized and configured to receive the outer rotor 14. The housing 18 may have a curved peripheral wall 22 that defines the periphery of the cavity 20 and that is sized and configured to contact the curved outer peripheral surface of the outer rotor 14 (e.g., generally a short cylinder or disk-shaped) as it rotates. The housing 18 may also include a bottom surface 24. When the rotor assembly 16 is disposed within the cavity 20, the bottom surface 24 may be contacted by the inner rotor 12 and/or outer rotor 14 on one of their flat surfaces, for example, when they are rotating.

The housing 18 may be mounted to a base 26, which may provide the oil inlet/supply to the housing 18. The housing 18 may be mounted or attached to the base 26 using any suitable method, for example, mechanical fasteners and/or adhesives. In general, the base 26 may not contact the rotor assembly 16, for example, when they are rotating. However, contact may be possible based on the design of the pump 10. A cover 28 may be mounted to the top of the housing 18, opposite the base 26. A bottom surface of the cover (e.g., closest to the base 26) may be contacted by the inner rotor 12 and/or outer rotor 14 on one of their flat surfaces, for example, when they are rotating.

Accordingly, the oil pump 10 may include one or more (e.g., a plurality) of surfaces that are in contact with the rotor assembly 16, including when the rotor assembly 16 is moving/rotating. In at least one embodiment, the inner rotor 12 and/or the outer rotor 14 may be formed of steel. In another embodiment, the housing 18, base 26, and/or cover 28 may be formed of aluminum. Therefore, the one or more surfaces where there is contact between the rotor assembly 16 and the rest of the oil pump 10 (e.g., while rotating) may include aluminum-steel interfaces. As described above, these interfaces may result in higher wear rates than steel-steel interfaces, which may result in a shorter service life or the need for a retroactive steel insert.

Figure 2:
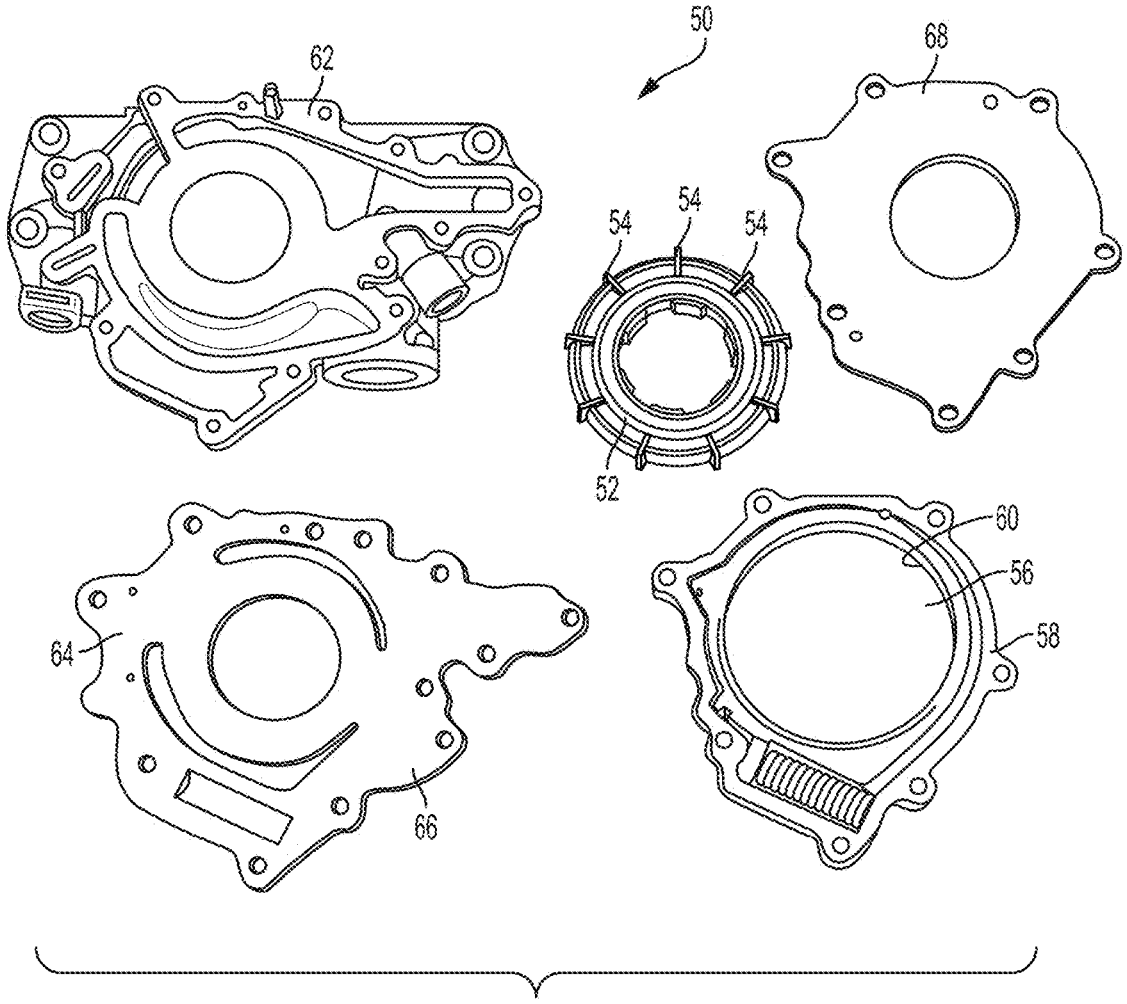
FIG. 2 is a perspective view of disassembled components of a variable vane pump, according to an embodiment.

With reference to FIG. 2, an example of a rotary vane pump 50 is shown, also referred to as variable vane pump. Variable vane pumps are known in the art and will not be described in detail. Variable vane pumps are a type of positive-displacement pump that generally include vanes 54 coupled to a rotor 52 that rotates inside of a cavity 56 defined in a housing 58. The vanes 54 may be considered part of the rotor assembly. Depending on the particular design of the pump, the vanes 54 may have variable length and/or be tensioned to maintain contact with a wall 60 of the housing 58 as the rotor 52 rotates. The rotor 52 may be circular in shape and may rotate inside a circular cavity 56. However, designs of the pump may vary, and these shapes are not necessarily the same for all pump designs. The centers of rotor 52 and the cavity 56 may be offset, causing eccentricity. The vanes 54 may be configured to slide into and out of the rotor 52. The vanes 54 may form a seal with the housing 58 around a periphery of the wall 60 that defines the cavity 56. This seal may create vane chambers that perform the pumping. On the intake side of the pump, the vane chambers may increase in volume, reducing the pressure and causing the fluid (e.g., oil) to be taken in. On the discharge side of the pump, the vane chambers may decrease in volume, thereby pumping the fluid out of the pump.

The pump 50 may include a base 62, which may provide the oil inlet/supply to the housing 58. A base plate 64 having a top surface 66 may be mounted or attached to the base 62. When pump 50 is assembled, the housing 58 may be mounted to base plate 64 and the rotor 52 may be disposed within the cavity 56 of housing 58. A cover 68 may then be mounted to the top of the housing 58, opposite the base plate 64. In general, the base 62 may not contact the rotor 52 or vanes 54. However, contact may be possible based on the design of the pump 50. When the rotor 52 is disposed within the cavity 56, the top surface 66 of the base plate 64 may be contacted by the rotor 52 and/or the vanes 54 on their bottom surfaces (e.g., when they are rotating). In addition, a bottom surface of the cover 68 (e.g., surface closest to the base plate 64) may be contacted by the rotor 52 and/or the vanes 54 on their top surfaces (e.g., when they are rotating).

The pump 50 may include a base 62, which may provide the oil inlet/supply to the housing 58. In general, the base 62 may not contact the rotor 52 or vanes 54, for example, when they are rotating. However, contact may be possible based on the design of the pump 50. A base plate 64 may be mounted or attached to the base 62. The base plate 64 may be mounted or attached to the base 62 using any suitable method, for example, mechanical fasteners and/or adhesives. The base plate 64 may have a top surface 66. When the rotor 52 is disposed within the cavity 56, the top surface 66 may be contacted by the rotor 52 and/or the vanes 54 on their bottom surfaces, for example, when they are rotating. A cover 68 may be mounted to the top of the housing 58, opposite the base plate 64. A bottom surface of the cover (e.g., closest to the base plate 64) may be contacted by the rotor 52 and/or the vanes 54 on one of their top surfaces, for example, when they are rotating.

Accordingly, the oil pump 50 may include one or more (e.g., a plurality) of surfaces that are in contact with the rotor 52 and/or vanes 54, including when the rotor and vanes are moving/rotating. For example, the wall 60, the top surface 66 of the base plate 64, and/or the bottom surface of the cover 68 may make contact with the rotor 52 and/or vanes 54 when the pump is operating. In at least one embodiment, the rotor 52 and/or the vanes 54 may be formed of steel. In another embodiment, the housing 58, base plate 64, and/or cover 68 may be formed of aluminum. Therefore, the one or more surfaces where there is contact between the rotor/vanes and the rest of the oil pump 50 (e.g., while rotating) may include aluminum-steel interfaces. As described above, these interfaces may result in higher wear rates than steel-steel interfaces, which may result in a shorter service life or the need for a retroactive steel insert.

In at least one embodiment, a coating may be applied to at least a portion of an oil pump (e.g., oil pumps 10 or 50) where there is an aluminum-steel interface. In one embodiment, the interface may be where there is relative motion between a rotor assembly and the other components of the pump, for example, a gerotor rotor assembly or a variable vane rotor, as described above. However, the coating may be applied to any component in a pump (e.g., oil pump) where there is an aluminum-steel interface, and is not limited to the pump examples described above. In one embodiment, any and/or all aluminum surfaces that are configured to contact a moving or rotating steel component (e.g., rotor, or a part thereof, such as a vane) may have a coating applied thereto. In another embodiment, only the aluminum surfaces that are configured to contact a moving or rotating steel component (e.g., rotor, or a part thereof, such as a vane) may have a coating applied thereto.

The coating may be applied using any suitable process. In one embodiment, the coating may be a sprayed coating, such as a thermally sprayed coating. Non-limiting examples of thermal spraying techniques that may be used to form the coating may include plasma spraying, detonation spraying, wire arc spraying (e.g., plasma transferred wire arc, or PTWA), flame spraying, high velocity oxy-fuel (HVOF) spraying, warm spraying, or cold spraying. Other coating techniques may also be used, such as vapor deposition (e.g., PVD or CVD) or chemical/electrochemical techniques. In at least one embodiment, the coating is a coating formed by plasma transferred wire arc (PTWA) spraying.

An apparatus for spraying the coating may be provided. The apparatus may be a thermal spray apparatus including a spray torch. The spray torch may include torch parameters, such as atomizing gas pressure, electrical current, plasma gas flow rate, wire feed rate and torch traverse speed. The torch parameters may be variable such that they are adjustable or variable during the operation of the torch. The apparatus may include a controller, which may be programmed or configured to control and vary the torch parameters during the operation of the torch. Examples of a spray torch and its operation are described in commonly owned application U.S. application Ser. No. 15/064,903, filed Mar. 9, 2016, the disclosure of which is hereby incorporated in its entirety by reference herein. The controller may include a system of one or more computers which can be configured to perform particular operations or actions by virtue of having software, firmware, hardware, or a combination thereof installed on the system that in operation causes or cause the system to perform the disclosed actions. One or more computer programs can be configured to perform particular operations or actions by virtue of including instructions that, when executed by the controller, cause the apparatus to perform the actions.

The coating may be any suitable coating that provides sufficient hardness, strength, stiffness, density, wear properties, friction, fatigue strength, and/or thermal conductivity for an oil pump, for example, an oil pump cavity wherein there is at least one aluminum-steel wear surface. In at least one embodiment, the coating may be a metal coating, such as an iron or steel coating. Non-limiting examples of suitable steel compositions may include any AISI/SAE steel grades from 1010 to 4130 steel. The steel may also be a stainless steel, such as those in the AISI/SAE 400 series (e.g., 420). However, other steel compositions may also be used. The coating is not limited to irons or steels, and may be formed of, or include, other metals or non-metals. In one embodiment, the coating may be formed of a material that is more dense than aluminum and/or the housing material. In other embodiments, the coating may be a ceramic coating, a polymeric coating, or an amorphous carbon coating (e.g., DLC or similar). The coating type and composition may therefore vary based on the application and desired properties. In addition, there may be multiple coating types applied to the oil pump. For example, different coating types (e.g., compositions) may be applied to different regions of the oil pump (e.g., the surfaces described above).

In one embodiment, the microhardness of the coating may be from 150 to 600 HV, or any sub-range therein. For example, the microhardness of the coating may be from 200 to 600 HV, 300 to 600 HV, 200 to 500 HV, 200 to 400 HV, 250 to 500 HV, or 250 to 400 HV. The coating may also be a low-wear coating, and may be optimized to obtain as low of a wear rate as possible. The coating may also have a relatively low coefficient of friction (COF). In one non-limiting example, the COF may be 0.4 or lower in practice.

In general, the process of applying the coating may include several steps. First, the surface to be coated, such as an aluminum-steel wear surface, may be prepared to receive the coating. The surface preparation may include roughening and/or washing of the surface to improve the adhesion/bonding of the coating. However, in some embodiments there coating may be applied to the oil pump surface(s) without any initial preparation. Next, the deposition of the coating may begin. The coating may be applied in any suitable manner, such as spraying. In one example, the coating may be applied by thermal spraying, such as PTWA spraying. The coating may be applied from a spray nozzle on the thermal spray torch. The coating may include one or more (e.g., a plurality) layers, with each layer of the coating being applied using the same or adjusted deposition parameters.

Figure 3:
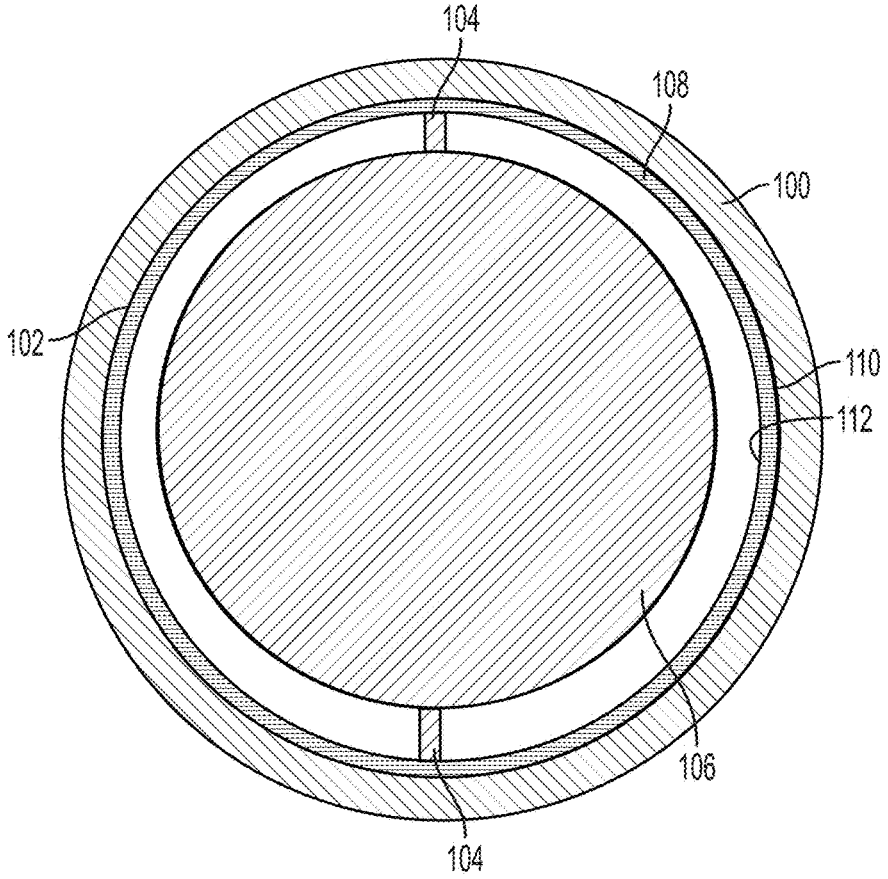
FIG. 3 is a schematic cross-section of an oil pump component having a coating applied thereon to form a wear surface, according to an embodiment.

With reference to FIG. 3, a schematic cross-section of an oil pump component 100 is shown. In the example shown, the component 100 may be a housing or a portion of a housing of a variable vane oil pump (e.g., such as housing 58). The component 100 is shown in a simplified form for illustration purposes, and is not intended to be limiting. In addition, the component 100 may be a component in any type of oil pump, such as a housing in a gerotor pump, or it may be a component other than a housing. The component 100 may be formed of aluminum, either pure aluminum or an aluminum alloy. The component 100 may have a first surface 102 that conventionally would form a wear interface with a moving or rotating portion of an oil pump. For example, as shown, the first surface 102 may be a peripheral wall surface of a variable vane pump that is configured to contact the vanes 104 of a moving rotor 106.

As described above, the rotor/vanes may be formed of steel. Therefore, in conventional oil pumps, the wear interface between the moving rotor/vanes and the surface 102 would be an aluminum-steel wear interface. However, in at least one embodiment, a coating 108 may be applied to the surface 102. The coating 108 may cover all or at least a portion of the surface 102. The coating 108 may include an interface surface 110 that is in contact with the surface 102 and an opposing wear surface 112, which may be a free surface. Accordingly, the wear surface 112 of the coating 108 may become the new wear interface with the moving rotor where the coating 108 is present.

In another embodiment, the surface 102 may be integrated into another component, for example, instead of a stand-alone component, such as oil pump housing. In one embodiment, the housing, or a portion thereof, of an oil pump may be integrated into the front cover an engine (e.g., ICE) or a transmission cover/housing. The coating 108 may then be applied to the surface 102 of the integrated component (e.g., engine front cover) to provide at least a portion of a wear interface/surface for a moving oil pump component. The coating 108 may have a composition and application process as described above. In one embodiment, the coating 108 may be a steel coating, in which case the wear interface may be a steel-steel interface. The disclosed component may therefore combine the benefits of lightweight materials, such as aluminum, with the wear properties of steel. This may provide a lightweight oil pump that remains durable and may have a long service life.

Figure 4:
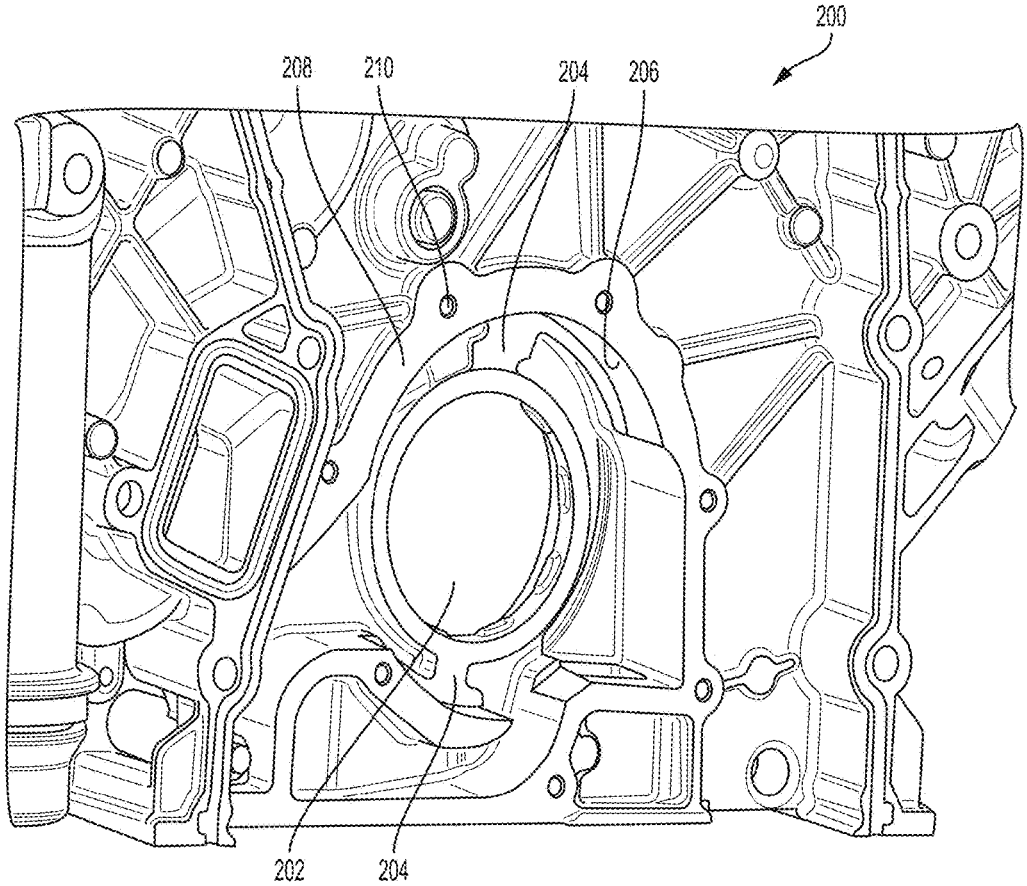
FIG. 4 is a perspective view of an engine front cover having a portion of an oil pump housing integrated therein, according to an embodiment.

With reference to FIG. 4, an example of a component having a portion of an oil pump housing is shown. In this example, the component is an engine front cover 200. The front cover 200 may be formed of aluminum (e.g., pure or an alloy). The front cover 200 may be cast, for example, using die casting (e.g., HPDC). The casting process may allow for a body of the front cover 200 to have included therein a recess or cavity 202 therein that may form a portion of an oil pump. For example, the cavity 202 may replace all or a portion of an oil pump housing (e.g., housing 18 or housing 58) that receives a moving or rotating part, such as the rotors of a gerotor or variable vane oil pump. The front cover 200 may include a mating or joining surface 208, which may be configured to attach to components of an oil pump to form an integrated oil pump and front cover assembly. The joining surface 208 may include openings or apertures 210 configured to receive mechanical fasteners to couple the oil pump to the front cover 200. However, other attachment methods may be used instead of (or in addition to) mechanical fasteners, such as adhesives.

The front cover 200 may include one or more flat or substantially flat surfaces 204 that partially define the cavity 202. These surfaces may be similar to or provide the functionality similar to bottom or top surfaces of the housing or base/cover plates described above. The front cover 200 may also include a peripheral wall 206 that at least partially defines the cavity 202, which may be similar to the walls 22 and 60 described above. Accordingly, surfaces 204 and/or 206 may contact a moving component (e.g., a rotor) of an oil pump integrated into the front cover 200. A portion or all of the surfaces 204 and 206 may therefore receive a coating, as described above. Embodiments where the oil pump is at least partially integrated with another component, such as an engine front cover, may receive the greatest benefit from the applied coating to wear surfaces. This may be because the front cover is a relatively complex component that may be difficult to repair once a vehicle is assembled. Therefore, applying a wear-resistant coating to the aluminum-steel interfaces may increase the lifespan of the oil pump and/or prevent the need for a potentially difficult or laborious repair.

Figure 5:
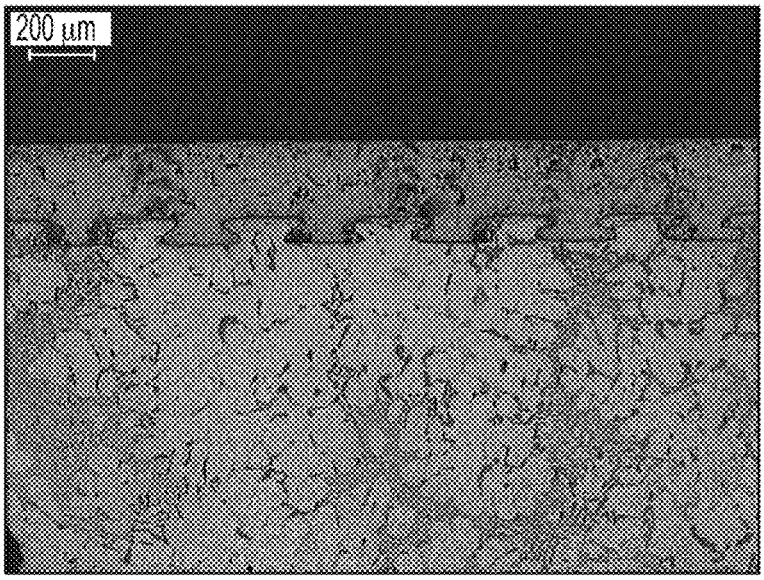
FIG. 5 is a cross-section of a steel coating applied to the surface of an aluminum oil pump cavity.

With reference to FIG. 5, a cross-section of a coating applied to the surface of an aluminum oil pump cavity is shown. The coating shown is a PTWA steel coating, however, as described above, other coating methods and/or compositions may be used. In this example, the aluminum surface was roughened prior to the application of the coating to create grooves having undercuts. The undercuts may improve the adhesion of the coating to the aluminum surface. However, a roughened surface, for example a surface including undercuts, is not required, and some embodiments may include a smooth or relatively smooth surface.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. An oil pump, comprising:

an aluminum housing that defines a cavity;

a steel rotor disposed within the cavity and configured to rotate therein such that a portion of the steel rotor contacts the aluminum housing; and a metal coating covering at least a portion of the aluminum housing in a region that is configured to be contacted by the steel rotor.

2. The oil pump of claim 1, wherein the aluminum housing includes a wall defining a peripheral surface of the cavity and the metal coating covers at least a portion of the wall.

3. The oil pump of claim 2, wherein the wall includes a substantially cylindrical portion and the metal coating covers at least a portion of the substantially cylindrical portion.

4. The oil pump of claim 1, wherein the metal coating is a steel coating, such that there is a steel-steel interface in the region of the aluminum housing that is configured to be contacted by the steel rotor.

5. The oil pump of claim 1, wherein the metal coating has a microhardness of 200 to 600 HV.

6. The oil pump of claim 1, wherein the metal coating covers every surface of the aluminum housing that is configured to be contacted by the steel rotor.

7. The oil pump of claim 1, wherein the metal coating covers only surfaces of the aluminum housing that are configured to be contacted by the steel rotor.

8. The oil pump of claim 1, wherein the steel rotor is an outer rotor of a gerotor pump and has a substantially cylindrical outer wall; and the metal coating covers a peripheral surface of the aluminum housing that is configured to be contacted by the outer wall of the steel rotor.

9. The oil pump of claim 1, wherein the oil pump is a variable vane oil pump and the steel rotor includes a plurality of steel vanes; and the metal coating covers a peripheral surface of the aluminum housing that is configured to be contacted by the steel vanes of the steel rotor.

10. A method, comprising:

applying a metal coating to a surface of an aluminum oil pump housing that is configured to receive a steel rotor, the metal coating configured to form a wear interface with the steel rotor when the steel rotor moves within the housing.

11. The method of claim 10, wherein the metal coating is applied to a peripheral wall surface of the housing that defines a cavity to receive the steel rotor.

12. The method of claim 10, wherein applying the metal coating includes thermally spraying a steel coating onto the surface, the steel coating configured to form a steel-steel wear interface with the steel rotor.

13. The method of claim 10, wherein applying the metal coating includes covering every surface of the housing that is configured to contact the steel rotor when it moves within the housing with the metal coating.

14. The method of claim 10, wherein applying the metal coating includes covering only surfaces of the housing that are configured to contact the steel rotor when it moves within the housing with the metal coating.

15. The method of claim 10, wherein the aluminum oil pump housing is integrally formed in an engine front cover.

16. An engine cover, comprising:

an aluminum body including a peripheral wall defining a cavity, the peripheral wall configured to form a portion of an oil pump housing and the cavity configured to receive a steel rotor; and a wear-resistant coating covering at least a portion of the peripheral wall in a region that is configured to be contacted by the steel rotor.

17. The engine cover of claim 16, wherein the wear-resistant coating is a steel coating having a microhardness of 200 to 600 HV.

18. The engine cover of claim 16, wherein the wear-resistant coating covers a substantially cylindrical portion of the peripheral wall.

19. The engine cover of claim 16, wherein the wear-resistant coating covers every surface of the aluminum body that is configured to be contacted by the steel rotor.

20. The engine cover of claim 16, wherein the aluminum body further includes a joining surface having apertures defined therein and configured to couple the engine cover to one or more oil pump components to form an integrated oil pump and engine cover assembly.

* * * * *